US006010125A

United States Patent [19]

Nakajima

[11] Patent Number: 6,010,125

[45] Date of Patent: Jan. 4, 2000

[54] SHEET SUPPLYING APPARATUS AND RECORDING APPARATUS OR READING APPARATUS USING THE SAME

[75] Inventor: Hajime Nakajima, Tokyo, Japan

[73] Assignee: Canon Kabushiki Kaisha, Tokyo, Japan

[21] Appl. No.: 08/958,037

[22] Filed: Oct. 27, 1997

[30] Foreign Application Priority Data

Oct. 31, 1996 [JP] Japan ..... 8-305783

[51] Int. Cl.[7] ..... B65H 5/08

[52] U.S. Cl. ..... 271/11; 271/30.1; 271/104; 271/107; 271/145

[58] Field of Search ..... 271/5, 11, 30.1, 271/104, 107, 145, 148, 169, 170

[56] References Cited

U.S. PATENT DOCUMENTS

| | | | |
|---|---|---|---|
| 3,022,997 | 2/1962 | Pendley | 371/148 |
| 3,446,500 | 5/1969 | Meier | 271/148 |
| 4,593,895 | 6/1986 | Myers et al. | 271/148 |
| 5,560,596 | 10/1996 | Okoda et al. | 271/107 |

FOREIGN PATENT DOCUMENTS

| | | | |
|---|---|---|---|
| 403216430 | 9/1991 | Japan | 271/104 |
| 404272038 | 9/1992 | Japan | 271/107 |
| 406001466 | 1/1994 | Japan | 271/107 |
| 7-81787 | 3/1995 | Japan . | |

*Primary Examiner*—H. Grant Skaggs
*Attorney, Agent, or Firm*—Fitzpatrick, Cella, Harper & Scinto

[57] ABSTRACT

An apparatus for supplying sheets has a sheet containing portion containing a number of sheets therein, a conveying mechanism for absorbing the uppermost one of the number of sheets in the sheet containing portion, and taking the absorbed sheet out of the sheet containing portion, and a protuberance absorbing portion provided in the sheet containing portion, the absorbing portion being adapted to absorb the partial protuberance of the number of sheets during at least the sheet absorbing by the conveying mechanism.

9 Claims, 8 Drawing Sheets

SHEET SUPPLYING APPARATUS AND RECORDING APPARATUS OR READING APPARATUS USING THE SAME

BACKGROUND OF THE INVENTION

1. Field of the Invention

This invention relates to a sheet supplying apparatus for supplying sheets to an image recording apparatus or an image reading apparatus, and a recording apparatus or a reading apparatus for effecting the recording or reading of information on a sheet supplied by the use of this sheet supplying apparatus.

2. Related Background Art

Sheet supplying apparatuses have heretofore been widely used in a recording apparatus, a reading apparatus and other various apparatuses, and one disclosed, for example, in Japanese Laid-Open Patent Application No. 7-81787 is known. In this sheet supplying apparatus, as shown in FIG. 1 of the accompanying drawings, a number of sheets of film F piled on a sheet holding member 1 may be supplied to a recording apparatus or a reading apparatus, not shown, by the following action.

A driving portion is comprised of a first drive source 2 and a second drive source 3, and if the second drive source 3 is operated when the first drive source 2 is inoperative, then a screw portion 4*a* is rotated with a rotatable shaft 4 and a slider 6 is moved to the left with a nut 5. By the slider 6 being moved, a pin 7 slides leftwardly in the pin guide hole 8*a* of an arm supporting member 8, and arms 9 and 10 are pivotally moved about a support shaft 11 and a suction pad supporting member 12 is moved downwardly. Suction pads 15 and 16 mounted on the suction pad supporting member 12 through nipples 13 and 14, respectively, come into contact with the surface of the film F and the suction pads 15 and 16 adhere to the film F by the operation of a vacuum pump, not shown. When in this state, both of the first drive source 2 and the second drive source 3 are operated, the rotatable shaft 4 and the arm supporting member 8 are rotated at the same speed in the same direction and the suction pad supporting member 12 supplies the uppermost film F to the recording apparatus or the reading apparatus while the spacing between it and the rotatable shaft 4 keeps constant.

In recent years, it has often been the case that a seal having identification information is stuck on the film F at a location which will not hinder recording or reading. The thickness of this kind of seal is often e.g. 20–100 $\mu$m and therefore, when a number of sheets of film F with a seal are stacked, a protuberant portion Fa by the piling of the seals is created in the film F. This has given rise to the problem that in a sheet supplying apparatus according to the conventional art or a recording apparatus or a reading apparatus using such device, one suction pad 15 alone is applied to the protuberant portion Fa of the film F and the stable supply of the film F becomes impossible.

SUMMARY OF THE INVENTION

It is a first object of the present invention to solve the above-noted problem and to provide a sheet supplying apparatus capable of effecting the stable supply of sheets even when there is a protuberant portion in the sheets, and a recording apparatus or a reading apparatus using such device.

Other objects of the present invention will become apparent from the following detailed description of some embodiments of the invention.

To achieve these objects, a device for supplying sheets according to the present invention is basically provided with:

- a sheet containing portion containing a number of sheets therein;
- a conveying mechanism for absorbing the uppermost one of the number of sheets in the sheet containing portion, and taking the absorbed sheet out of the sheet containing portion; and
- a protuberance absorbing portion provided in the sheet containing portion, the absorbing portion being adapted to absorb the partial protuberance of the number of sheets during at least the sheet absorbing by the conveying mechanism.

DESCRIPTION OF THE PREFERRED EMBODIMENTS

The present invention will hereinafter be described in detail with respect to some embodiments thereof shown in FIGS. 2A, 2B, 3 to 7.

Figure 1:
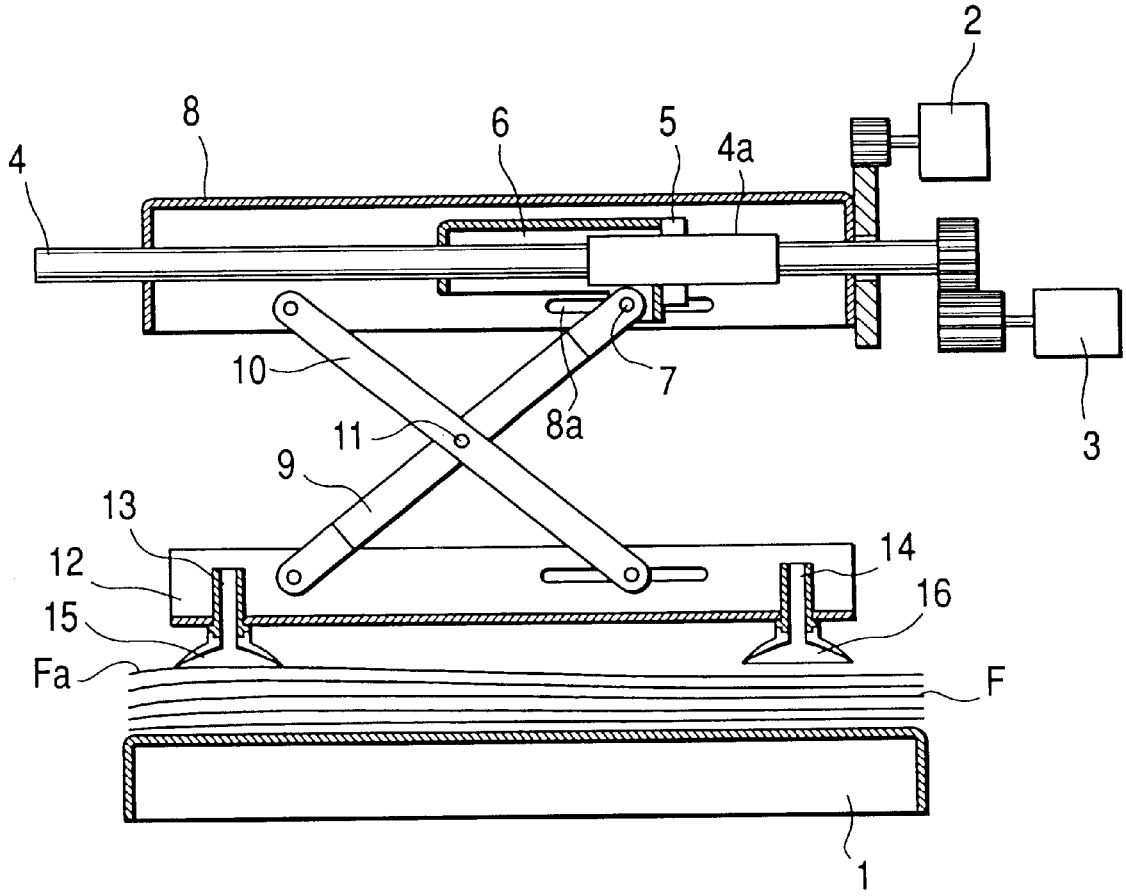
FIG. 1 is a longitudinal cross-sectional view of a sheet supplying apparatus according to the conventional art.
Figure 2A:
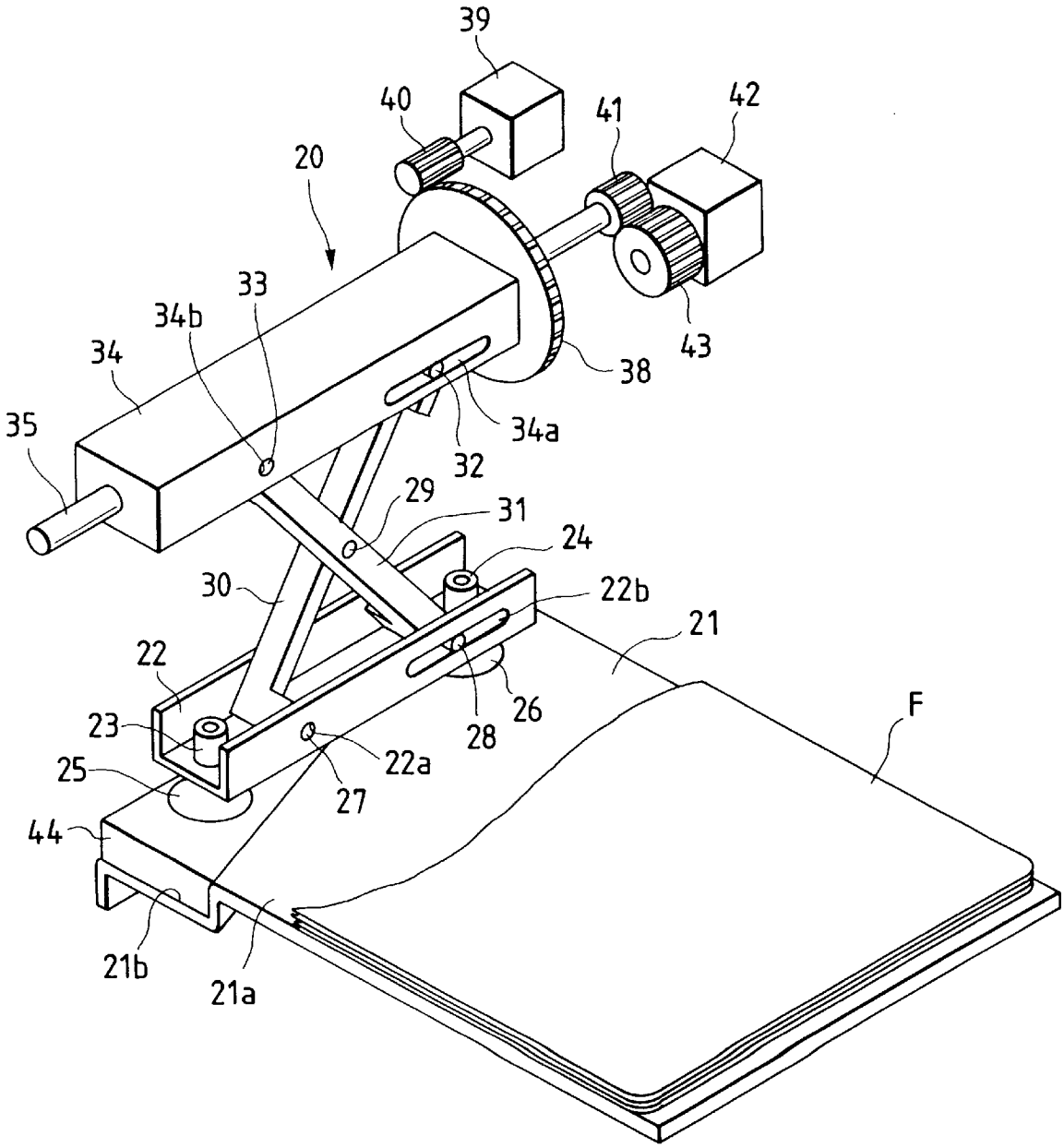
FIGS. 2A and 2B are a perspective view and a longitudinal cross-sectional view, respectively, of a sheet supplying apparatus according to a first embodiment of the present invention.
Figure 2B:
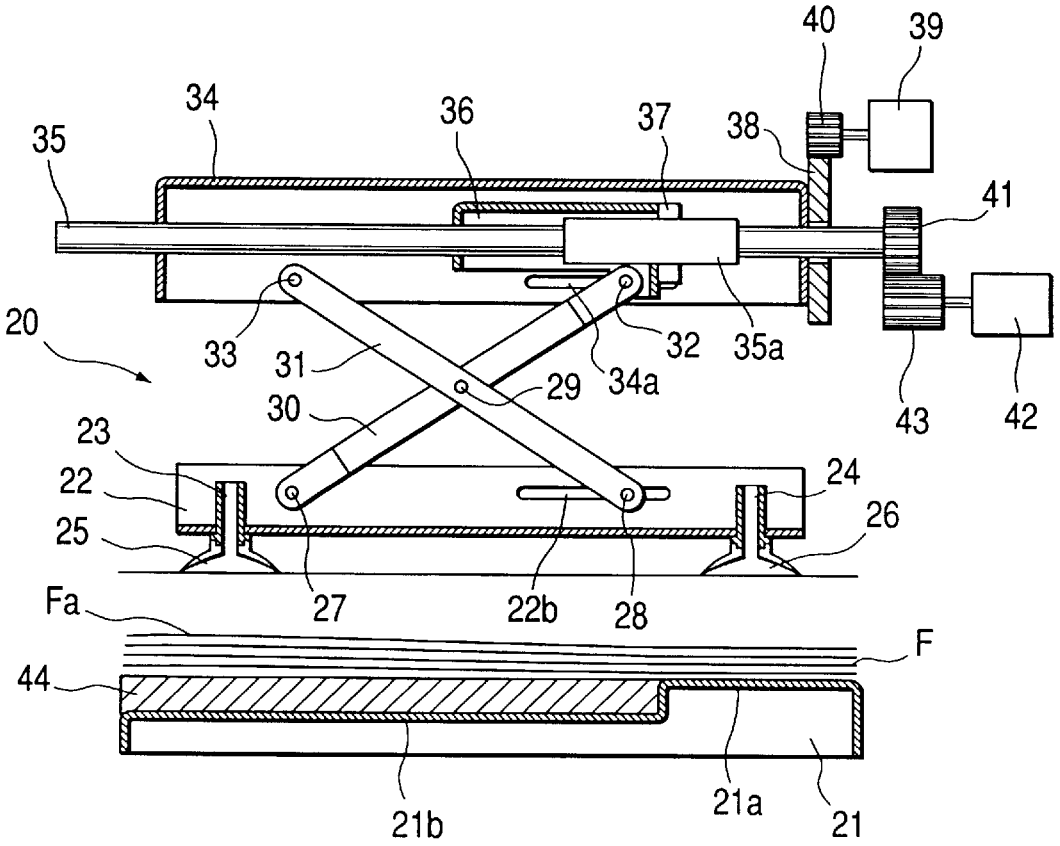
Figure 3:
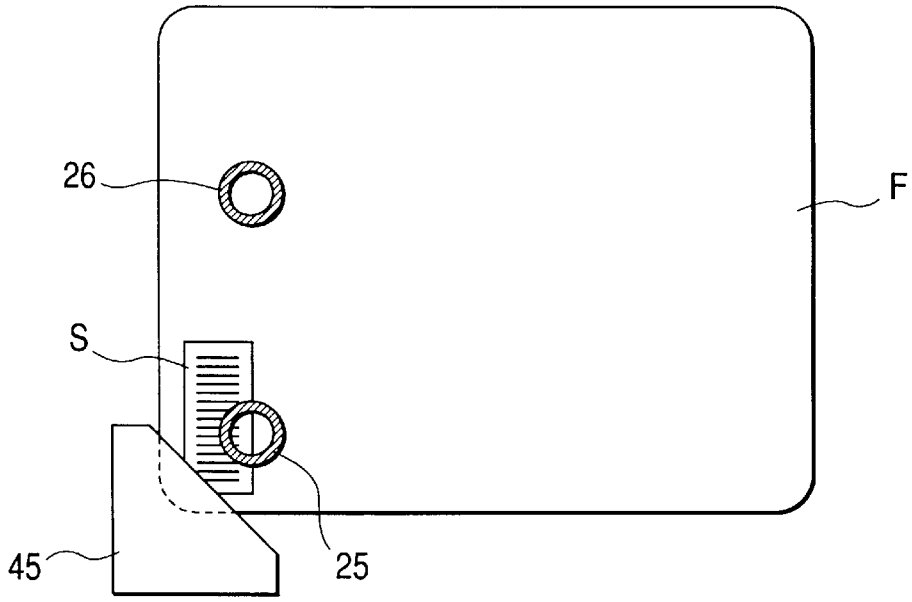
FIG. 3 is a fragmentary horizontal cross-sectional view of the sheet supplying apparatus of FIGS. 2A and 2B.

FIG. 2A is a perspective view of a sheet supplying apparatus 20 according to a first embodiment of the present invention, FIG. 2B is a longitudinal cross-sectional view thereof, and FIG. 3 is a fragmentary horizontal cross-sectional view thereof, and a number of sheets of film F for medical treatment information are filed on the upper surface of a bed-like sheet holding member 21. A seal S provided with a bar code is stuck on a corner of each of these sheets of film F, and a protuberant portion Fa by the seals S is created in the sheets of film F.

A suction cup holding member 22 of U-shaped cross-section is disposed above the sheet holding member 21, and nipples 23 and 24 are fitted and fixed to the bottom wall of the suction cup holding member 22. Suction cups 25 and 26 are mounted on the lower portions of these nipples 23 and 24, respectively, and the upper portions of the nipples 23 and 24 are connected to a vacuum pump, not shown, through flexible tubes. A pin holding hole 22*a* and a pin guide hole 22*b* opposed to each other are formed in the opposite side walls of the suction cup holding member 22, and a pin 27 is rotatably inserted in the pin holding hole 22*a* and a pin 28 is rotatably and slidably inserted in the pin guide hole 22*b*.

The suction cup holding member 22 is supported by arms 30 and 31 rotatably and crosswise supported by a pin 29. The lower ends of the arms 30 and 31 are coupled to the pins 27 and 28, respectively, and the upper ends of the arms 30 and 31 are supported by an arm supporting member 34 by way of respective pins 32 and 33. Again in this case, the pin 32 is rotatably and slidably inserted in pin guide holes 34*a* formed in the opposite side walls of the arm supporting member 34 in opposed relationship with each other, and the pin 33 is rotatably inserted in a pin holding hole 34*b*. Thereby, the suction cup holding member 22 is supported in parallel with the arm supporting member 34 and is vertically movable relative to the arm supporting member 34.

Such an arm supporting member 34 is supported on a rotatable shaft 35, which in turn is rotatably supported by a frame, not shown. A slider 36 is axially slidably supported on the rotatable shaft 35, and a nut 37 is fixed to one end of the slider 36. The nut 37 is threadably engaged with a screw portion 35*a* formed on the rotatable shaft 35, and the lower portion of the slider 36 is connected to the pin 32. A gear 38 is fixed to one end of the arm supporting member 34, and this gear 38 is in meshing engagement with the gear 40 of a first drive source 39. Also, a gear 41 is fixed to one end of the rotatable shaft 35, and this gear 41 is in meshing engagement with the gear 43 of a second drive source 42. Thereby, the suction cup holding member 22 is made rotatable about the rotatable shaft 35.

The sheet holding member 21 is provided with an upper stepped portion 21*a* for holding most of the film F, and a lower stepped portion 21*b* located lower than the upper stepped portion 21*a* near the protuberant portion Fa of the film F. The plane shape of the lower stepped portion 21*b* is e.g. a triangle in which the area on the suction cup 25 side is larger, and an elastic member 44 is disposed on the lower stepped portion 21*a*. Sponge, rubber or the like is used as the elastic member 44, and is formed to such a thickness that the surface thereof substantially coincides with the surface of the upper stepped portion 21*a*. A pawl member 45 is disposed above a corner of the film F which is adjacent, for example, to the suction cup 25, and design is made such that the film F absorbed by the suction cups 25 and 26 and upwardly transferred is temporarily held down by the pawl member 45, whereby it is reliably separated from the next layer of film F. The pawl member 45 can also be provided above a corner which is adjacent to the suction cup 26.

In the sheet supplying apparatus 20 thus constructed, when the second drive source 42 is operated when the first drive source 39 is inoperative, the screw portion 35*a* is rotated with the rotatable shaft 35 and the slider 36 is moved to the left with the nut 37. Thereby, the pin 32 slides leftwardly in the pin guide hole 34*a* and the arms 30 and 31 pivotally move about the pin 29, whereby the suction cup holding member 22 descends horizontally.

Figure 4:
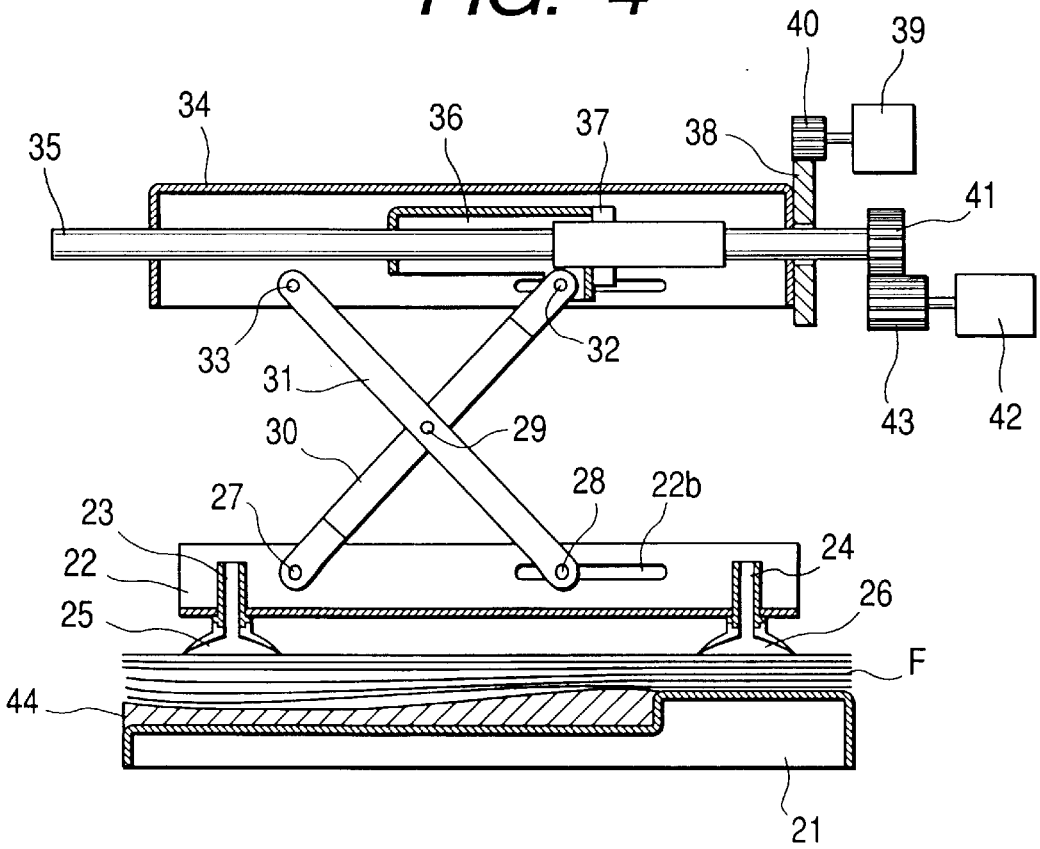
FIG. 4 illustrates the action of the sheet supplying apparatus of FIGS. 2A and 2B.

When the suction cup holding member 22 descends, one suction cup 25 presses the protuberant portion Fa of the film F as shown in FIG. 4, and flattens the surface of the film F while deforming the upper surface of the elastic member 44. Thereafter, both suction cups 25 and 26 bear against the film F and adhere to the film F by the action of the vacuum pump.

Figure 5:
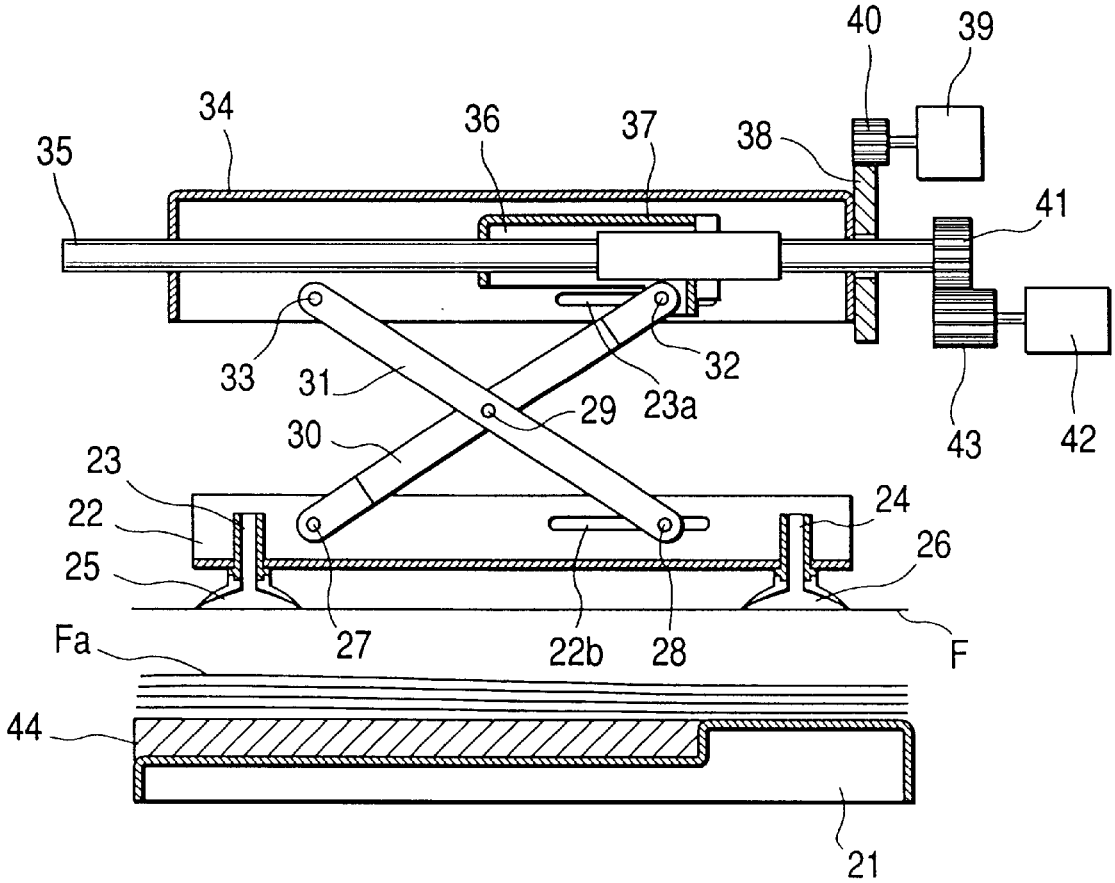
FIG. 5 illustrates the action of the sheet supplying apparatus of FIGS. 2A and 2B.

When in this state, the second drive source 42 is reversely rotated, the suction cup holding member 22 ascends to a predetermined position as shown in FIG. 5. At this time, the elastic member 44 returns to its original state, whereby the protuberant portion Fa appears again on the upper surface of the film F, and the pawl member 45 bends a corner of the film F to thereby separate only the uppermost film F from the next layer of film F. When both of the first drive source 39 and the second drive source 42 are operated, the rotatable shaft 35 and the arm supporting member 34 are rotated at the same angular speed in the same direction, and the suction cup holding member 22 supplies the film F to an image reading apparatus, not shown, while its spacing with respect to the rotatable shaft 35 is maintained constant.

As described above, in the first embodiment, when the suction cups 25 and 26 press the surface of the film F, the elastic member 44 absorbs the protuberant portion Fa of the film F while being deformed and therefore, the suction cups 25 and 26 can well adhere to the film F without locally striking against the film F, and the stable supply of the film F becomes possible.

Figure 6A:
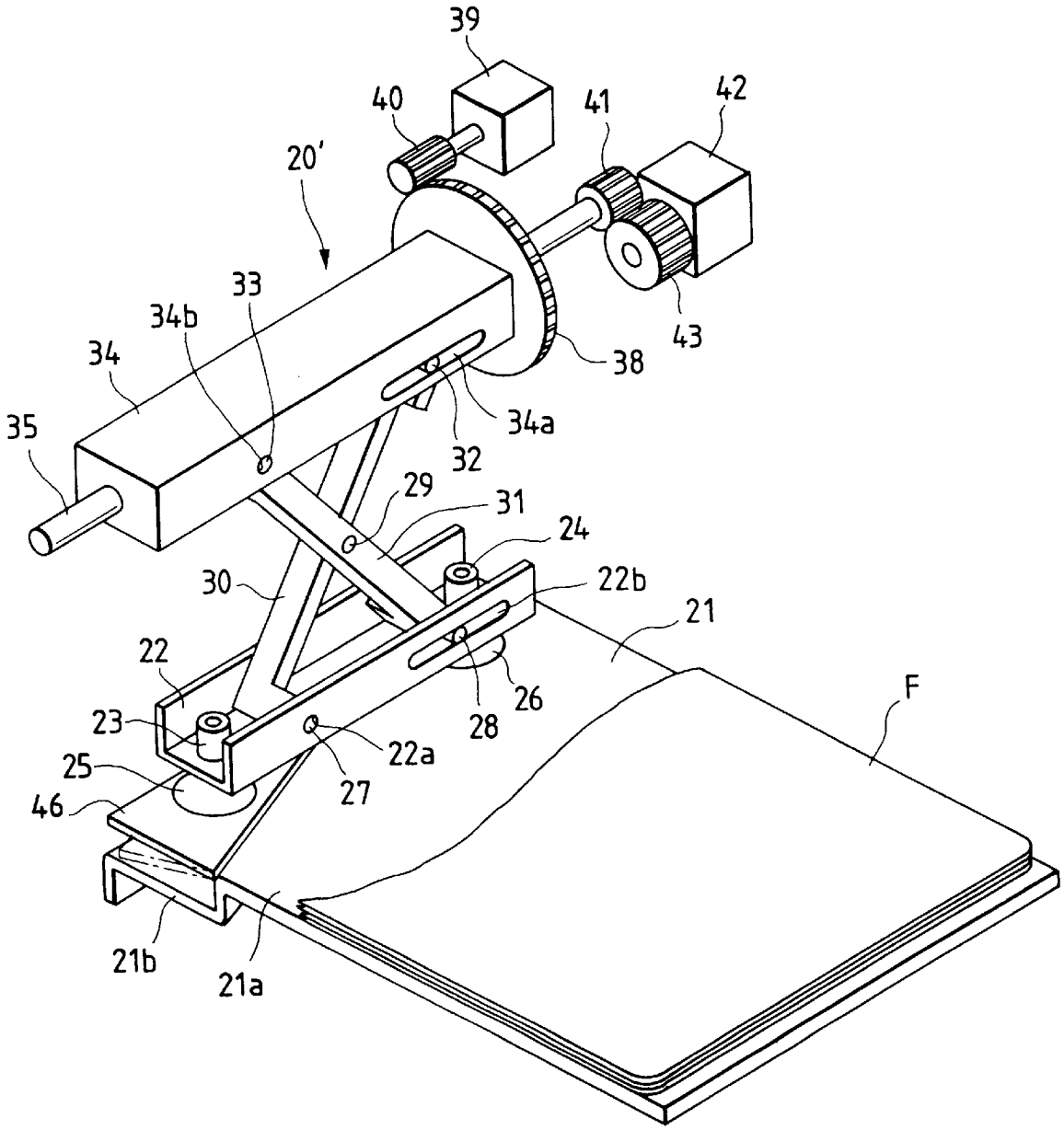
FIG. 6A is a perspective view of a sheet supplying apparatus according to a second embodiment of the present invention.
Figure 6B:
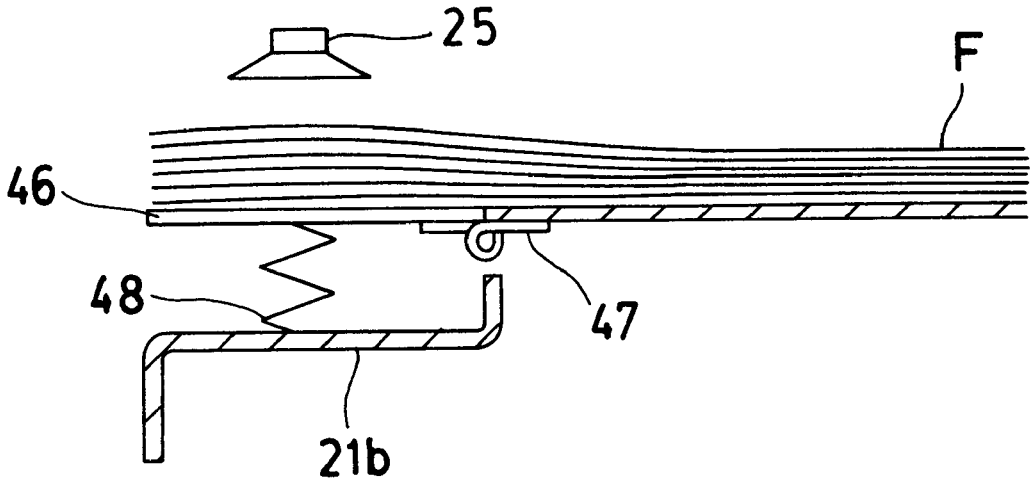
FIGS. 6B and 6C show a biasing feature of the apparatus shown in FIG. 6A.
Figure 6C:
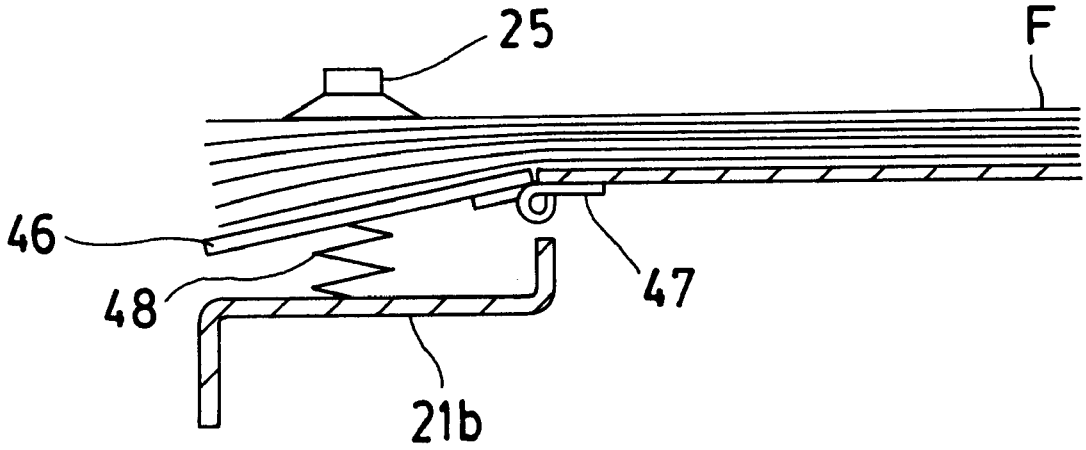

Referring now to FIG. 6A which is a perspective view of a sheet supplying apparatus 20' according to a second embodiment of the present invention, a pivotally rotatable plate 46 is provided instead of the elastic member 44 in the first embodiment. This pivotally rotatable plate 46 is such that the surface of a lower stepped portion 21*b* is supported through a hinge 47, shown in FIGS. 6B and 6C, so as to coincide with the surface of an upper stepped portion 21*a* and is horizontally held by a spring 48 shown in FIGS. 6B and 6C, disposed between the pivotally movable plate 46 and the lower stepped portion 21*b*.

In this second embodiment, when the suction cup 25 presses the protuberant portion Fa of the film F, the pivotally movable plate 46 pivotally moves as indicated by dot-and-dash line (FIG. 6A) while compressing the spring 47, thereby absorbing the protuberant portion Fa of the film F and therefore, an effect similar to that of the first embodiment can be obtained.

Figure 7:
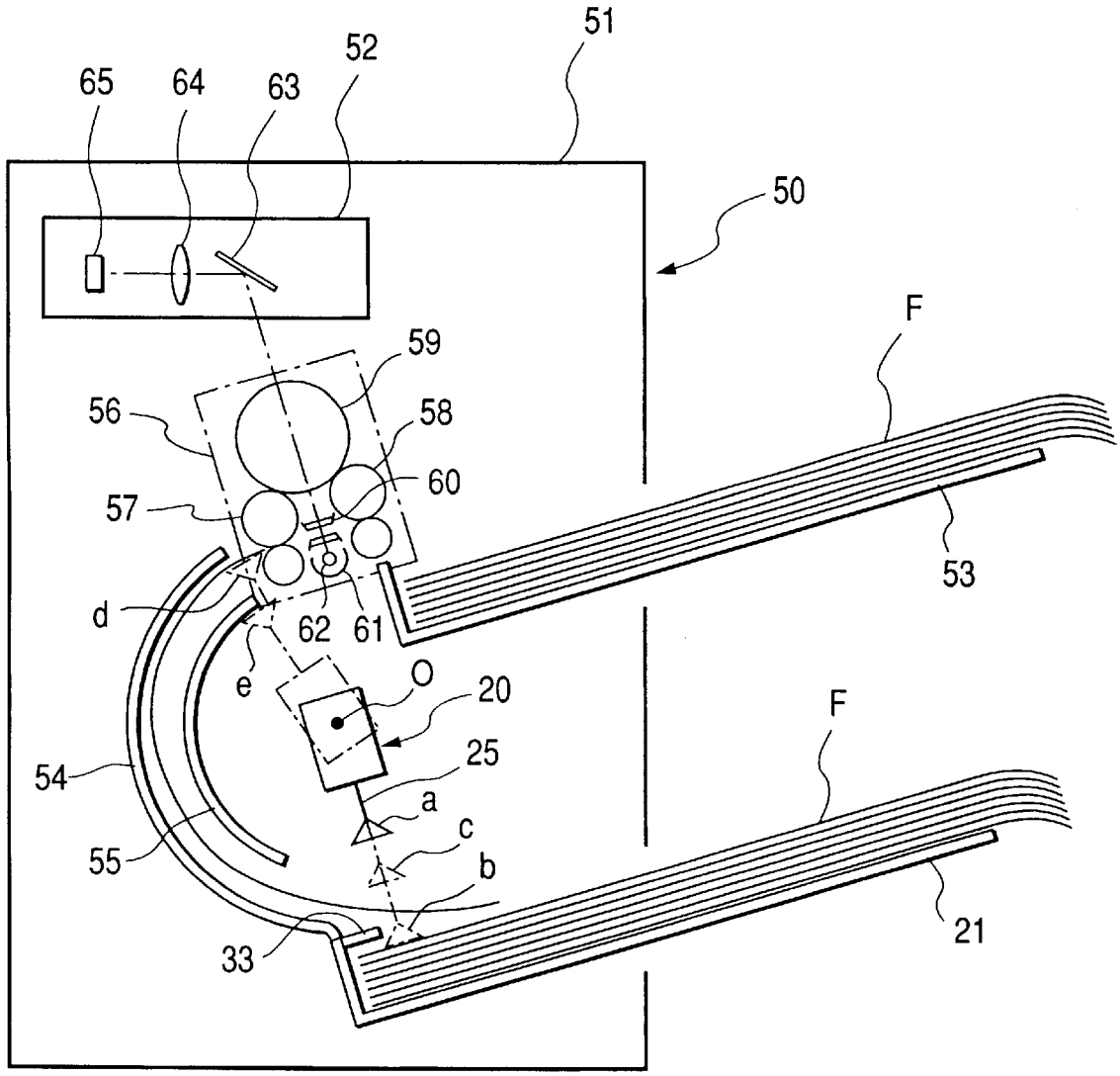
FIG. 7 shows the construction of an image reading apparatus according to a third embodiment of the present invention.

Referring now to FIG. 7 which shows the construction of an image reading apparatus 50 according to a third embodiment of the present invention, an optical unit 52 is contained in the upper portion of an apparatus body 51, and a sheet supplying apparatus 20 similar to the first embodiment is disposed in the lower portion of the apparatus body. A sheet receiving member 53 for receiving the film F is disposed between the optical unit 52 and the sheet supplying apparatus 20, and arcuate guides 54 and 55 are provided between the sheet holding member 21 and the front end of the sheet receiving member 53. These guides 54 and 55 are provided at a predetermined interval and in parallel with each other, and a subscanning mechanism 56 is provided between the fore ends of the guides 54, 55 and the sheet receiving member 53. Seal reading means, not shown, for reading the bar code of a seal S is provided in the apparatus body 51.

In the subscanning mechanism 56, a pair of first rollers 57 are provided on the guides 54, 55 side, and a pair of second rollers 58 are provided on the sheet receiving member 53 side, and one of these pairs of rollers 57 and 58 is connected to a drive motor, not shown. On the upper portions of the pairs of rollers 57 and 58, there is provided a pulley 59 for contacting with the rollers to thereby transmit the rotation of the rollers, and a pair of guides 60 each having a slit in the main scanning direction and a lamp 62 having a reflecting cover 61 turned to the optical unit 52 are provided in succession from above between the pairs of rollers 57 and 58 below the pulley 59. A reflecting mirror 63 for reflecting a light beam from the lamp 62, a lens 64 for imaging the light beam from the mirror 63, and a CCD 65 for receiving the light beam from the lens 64 are contained in the optical unit 52.

In the image reading apparatus 50 thus constructed, when the seal reading means reads the bar code of the seal S stuck on the film F, the suction cups 25 and 26 descend from "a" position a to a position "b" and adhere to the uppermost film F piled on the sheet holding member 21. If at this time, there is a protuberant portion Fa in the film F, the suction cups 25 and 26 flatten the film F as in the first embodiment, whereafter they adhere to the film F, and then ascend to a position "c". Subsequently, the suction cups 25 and 26 rotate about the center 0 of the sheet supplying apparatus 20 to thereby transfer the film F to a position "d" through between the guides 54 and 55, and insert the leading end of the film F between the pair of first rollers 57 of the subscanning mechanism 56. The suction cups 25 and 26 then liberate the film F and retract to a position "e" in which they do not interfere with the film F, and thereafter return to the position a.

The pair of first rollers 57 between which the film F has been inserted convey the film F to the pair of second rollers 58 at a constant speed. In the meantime, the lamp 62 exposes the film F and the light transmitted therethrough is reflected by the reflecting mirror 63 in the optical unit 52, and is transmitted through the lens 64 and is imaged on the CCD 65. Thereby, image information is read from the film F and finally, the pair of second rollers 58 discharge the film F onto the sheet receiving member 53.

If the optical unit 52 in the present embodiment is adapted for image recording on the film, the present apparatus will intactly become an image recording apparatus. As understood from this, the present invention is also applicable to an image recording apparatus.

In the third embodiment, the sheet supplying apparatus 20 of the first embodiment is used and therefore, even when a protuberant portion Fa is created in the film F, the stable supply of the film F becomes possible.

While the embodiments have been described with respect to a case where the film F having a maximum thickness of 0.25 mm is supplied, the present invention is of course applicable to sheets having a thickness greater than 0.25 mm.

As described above, the sheet supplying apparatus of each embodiment and the recording apparatus or the reading apparatus using this device are provided with absorbing means for absorbing the protuberant portion of sheets when the suction cups press the sheets and therefore, even when there is a protuberant portion in the surface of the sheets, the suction cups can adhere to the sheets while flattening the sheets and thus, a stable supply of the sheets becomes possible.

What is claimed is:

1. An apparatus for supplying sheets comprising:

a sheet placing portion for placing a number of sheets thereat;

a conveying mechanism for adhering to the uppermost one of said number of sheets in said sheet placing portion, and taking the adhered sheet out of said sheet placing portion; and a protuberance absorbing portion provided in said sheet placing portion, said absorbing portion being adapted to absorb a partial protuberance of said number of sheets during at least the sheet adhesion by said conveying mechanism, wherein upper surfaces of said number of sheets are flattened by cooperation of a moving action of said conveying mechanism for sheet adhesion and an absorbing action of said protuberance absorbing portion.

2. An apparatus according to claim 1, wherein said conveying mechanism comprises a suction member and presses said suction member against said uppermost sheet to thereby execute the sheet adhesion, and said absorbing portion absorbs the partial protuberance of said number of sheets during said pressing.

3. An apparatus according to claim 1, wherein said absorbing a portion absorbs partial protuberance attributable to a seal attached to each of said number of sheets.

4. An apparatus according to claim 3, wherein said seal comprises a bar code.

5. An apparatus according to claim 1, wherein said sheet placing portion includes an upper stepped portion and a lower stepped portion and wherein said absorbing portion has an elastic member disposed on said lower stepped portion of said sheet placing portion, said elastic member being formed to have a thickness so that a top surface of said elastic member coincides with a surface of said upper stepped portion of said sheet placing portion.

6. An apparatus according to claim 5, wherein said elastic member is comprises a sponge material.

7. An apparatus for supplying sheets having:

a sheet placing portion for placing a number of sheets thereat;

a conveying mechanism for adhering to the uppermost one of said number of sheets in said sheet holding portion, and taking the adhered sheet out of said sheet holding portion; and a protuberance absorbing portion provided in said sheet placing portion, said absorbing portion being adapted to absorb a partial protuberance of said number of sheets during at least the sheet adhesion by said conveying mechanism, wherein said sheet placing portion includes an upper stepped portion and a lower stepped portion and, wherein said absorbing portion has a movable plate disposed disposed over said lower stepped portion of said sheet placing portion, said movable plate being movably positioned so that a top surface of said movable plate coincides with a surface of said upper stepped portion of said sheet placing portion.

8. An apparatus according to claim 7, further comprising a biasing member wherein said movable plate is biased by said biasing member so that the upper surface of said movable plate coincides with a surface of said upper surface of said sheet placing portion.

9. An apparatus for effecting at least one process of information recording and information reading on a sheet comprising:

a process portion for effecting said process on the sheet;

a sheet placing portion for placing thereat a number of sheets to be processed by said processing portion;

a conveying mechanism for adhering to the uppermost one of said number of sheets in said sheet placing portion, and taking the adhered sheet out of said sheet placing portion; and a protuberance absorbing portion provided in said sheet placing portion, said absorbing portion being adapted to absorb the partial protuberance of said number of sheets during at least the sheet adhesion by said conveying mechanism, wherein upper surfaces of said number of sheets are flattened by cooperation of a moving action of said conveying mechanism for sheet adhesion and an absorbing action of said protuberance absorbing portion.

* * * * *

UNITED STATES PATENT AND TRADEMARK OFFICE

CERTIFICATE OF CORRECTION

PATENT NO. : 6,010,125

DATED : January 4, 2000

INVENTOR(S) : HAJIME NAKAJIMA

It is certified that error appears in the above-identified patent and that said Letters Patent is hereby corrected as shown below:

COLUMN 3

Line 33, "Sponge, rubber" should read --Sponge rubber--;

COLUMN 4

Line 66, ""a"" should read --a--; and

Line 67, "a to" should read --"a" to--.

COLUMN 5

Line 7, "through" should be deleted; and

Line 12, "a" should read --"a"--.

UNITED STATES PATENT AND TRADEMARK OFFICE

CERTIFICATE OF CORRECTION

PATENT NO. : 6,010,125

DATED : January 4, 2000

INVENTOR(S) : HAJIME NAKAJIMA

It is certified that error appears in the above-identified patent and that said Letters Patent is hereby corrected as shown below:

COLUMN 6

Line 5, "a portion absorbs" should read --portion absorbs a--;

Line 18, "is" should be deleted; and

Line 35, "disposed" should be deleted.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*